US009163870B2

(12) United States Patent
Jeon et al.

(10) Patent No.: US 9,163,870 B2
(45) Date of Patent: Oct. 20, 2015

(54) REFRIGERATOR

(71) Applicant: SAMSUNG ELECTRONICS CO., LTD., Suwon-si, Gyeonggi-do (KR)

(72) Inventors: Sang Woon Jeon, Namyangju-si (KR); Se Youn Park, Incheon (KR); Sun Min Lee, Seoul (KR); Jae Moon Lee, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/282,183

(22) Filed: May 20, 2014

(65) Prior Publication Data

US 2014/0375198 A1 Dec. 25, 2014

(30) Foreign Application Priority Data

Jun. 20, 2013 (KR) ..... 10-2013-0071029

(51) Int. Cl.
*F25D 23/00* (2006.01)
*F25D 23/02* (2006.01)
*F25D 23/06* (2006.01)

(52) U.S. Cl.
CPC ..... *F25D 23/028* (2013.01); *F25D 23/00* (2013.01); *F25D 23/02* (2013.01); *F25D 23/065* (2013.01); *F25D 2323/021* (2013.01)

(58) Field of Classification Search
CPC ..... F25D 23/00; F25D 23/02; F25D 23/028; F25D 2323/021
USPC ..... 312/405, 324
See application file for complete search history.

(56) References Cited

U.S. PATENT DOCUMENTS

| | | | | | |
|---|---|---|---|---|---|
| 4,711,098 | A * | 12/1987 | Kuwabara et al. | 62/441 |
| 5,411,328 | A * | 5/1995 | You | 312/405 |
| 5,694,789 | A * | 12/1997 | Do | 62/441 |
| 8,167,389 | B2 * | 5/2012 | Han et al. | 312/405 |
| 8,764,133 | B2 * | 7/2014 | Park et al. | 312/324 |
| 8,926,032 | B2 * | 1/2015 | Kuehl et al. | 312/405 |
| 2005/0046319 | A1 * | 3/2005 | Chekal et al. | 312/401 |
| 2007/0257589 | A1 * | 11/2007 | Laible | 312/405 |
| 2008/0209812 | A1 * | 9/2008 | Lancry et al. | 49/316 |

(Continued)

FOREIGN PATENT DOCUMENTS

| | | | |
|---|---|---|---|
| KR | 20-1990-0019051 | U | 4/1989 |
| KR | 10-2010-0035095 | A | 4/2010 |

OTHER PUBLICATIONS

Korean Notice of Allowance issued Mar. 31, 2015 in corresponding Korean Patent Application No. 10-2013-0071029.

*Primary Examiner* — Daniel Rohrhoff
(74) *Attorney, Agent, or Firm* — Staas & Halsey LLP

(57) ABSTRACT

A refrigerator in which a rotating bar installed to one of a pair of doors is rotated when the other door is opened or closed. The refrigerator includes a rotating bar to seal a gap between doors, and a guide device to guide rotation of the rotating bar. The guide device includes a base having a receptacle, a rotating unit mounted in the receptacle and rotated by a rotating shaft, a ramp structure fixed in the receptacle and having a ramp, a linkage unit linearly movably secured to the rotating unit and connected to the rotating bar so as to be linearly moved on the ramp and rotated along with the rotating unit about the rotating shaft, and an elastic unit supported by the rotating unit and adapted to transmit elastic force to the linkage unit to allow the linkage unit to move on the ramp.

30 Claims, 15 Drawing Sheets

(56) References Cited

U.S. PATENT DOCUMENTS

| | | | | |
|---|---|---|---|---|
| 2009/0113927 | A1* | 5/2009 | Laible | 62/449 |
| 2009/0273264 | A1* | 11/2009 | Butler | 312/405 |
| 2009/0320509 | A1* | 12/2009 | Gorz et al. | 62/264 |
| 2014/0097733 | A1* | 4/2014 | Seo et al. | 312/324 |
| 2014/0159560 | A1* | 6/2014 | Jung et al. | 312/405 |
| 2014/0217877 | A1* | 8/2014 | Miersen et al. | 312/405 |
| 2014/0265804 | A1* | 9/2014 | Wilson et al. | 312/405 |
| 2015/0015133 | A1* | 1/2015 | Carbajal et al. | 312/405 |
| 2015/0054396 | A1* | 2/2015 | Trulaske, Sr. | 312/405 |

* cited by examiner

REFRIGERATOR

CROSS-REFERENCE TO RELATED APPLICATIONS

This application claims the benefit of Korean Patent Application No. 10-2013-0071029, filed on Jun. 20, 2013 in the Korean Intellectual Property Office, the disclosure of which is incorporated herein by reference.

BACKGROUND

1. Field

Embodiments of the present disclosure relate to a refrigerator having a rotating bar configured to seal a gap between a pair of doors.

2. Description of the Related Art

In general, a refrigerator is a home appliance that keeps food fresh and includes food storage compartments and a cold air supply device.

Refrigerators may be classified based on the shape of storage compartments and doors. More specifically, refrigerators may be classified into a top mounted freezer refrigerator in which upper and lower storage compartments are separated from each other by a horizontal partition such that the upper storage compartment serves as a freezing compartment and the lower storage compartment serves as a refrigerating compartment, and a bottom mounted freezer refrigerator in which an upper storage compartment serves as a refrigerating compartment and a lower storage compartment serves as a freezing compartment.

In addition, there are a side by side refrigerator in which left and right storage compartments are separated from each other by a vertical partition such that one storage compartment serves as a freezing compartment and the other storage compartment serves as a refrigerating compartment, and a French Door Refrigerator (FDR) refrigerator in which upper and lower storage compartments are separated from each other by a horizontal partition such that the lower storage compartment serves as a freezing compartment and the upper storage compartment serves as a refrigerating compartment and is open or closed by a pair of doors.

Meanwhile, a door of the refrigerator is provided with a gasket to seal a gap between the door and a main body of the refrigerator when the door is closed.

In the case of the FDR refrigerator, however, since the upper refrigerating compartment is open or closed by the pair of doors, but is not provided with a vertical partition, a gap between the pair of doors may not be sealed by a gasket. Therefore, to seal a gap between the pair of doors, a rotating bar rotatably installed to either one of the pair of doors has been proposed.

When the pair of doors is closed, the rotating bar is rotated parallel to the pair of doors to seal a gap between the pair of doors. Then, when the door to which the rotating bar is installed is opened, the rotating bar is rotated perpendicular to the door so as not to interfere with the other door to which the rotating bar is not installed.

However, if the door to which the rotating bar is installed is closed and only the door to which the rotating bar is not installed is opened, the rotating bar remains rotated parallel to the pair of doors. Therefore, if storage containers arranged in left and right regions of the refrigerating compartment have the same size, removal of the storage container arranged in the refrigerating compartment toward the door to which the rotating bar is not installed may be impossible. For this reason, it may be necessary to arrange different sizes of storage containers in left and right regions of the refrigerating compartment.

SUMMARY

Therefore, it is an aspect of the present disclosure to provide a refrigerator in which a rotating bar, installed to one of a pair of doors to seal a gap between the pair of doors, is rotated even when the other door is opened or closed.

Additional aspects of the disclosure will be set forth in part in the description which follows and, in part, will be apparent from the description, or may be learned by practice of the disclosure.

In accordance with one aspect of the present disclosure, a refrigerator includes a main body, a storage compartment defined within the main body and having an open front side, a door including a first door and a second door rotatably coupled to the main body respectively so as to open or close the open front side of the storage compartment, the second door having a protrusion formed at an upper end of a rear surface thereof, a rotating bar rotatably coupled to the first door and having a guide groove formed in the top thereof, and a guide device provided at the main body to guide rotation of the rotating bar, wherein the guide device includes a rotating unit configured to be rotated by a rotating shaft, a linkage unit linearly movably secured to the rotating unit and connected to the rotating bar, the linkage unit being rotated along with the rotating unit about the rotating shaft so as to rotate the rotating bar, and an elastic unit supported by the rotating unit and adapted to allow the linkage unit to be linearly moved and rotated by transmitting elastic force to the linkage unit, and wherein if the protrusion rotates the rotating unit as the second door is closed, the rotating bar is rotated by the linkage unit that is rotated along with the rotating unit, thereby sealing a gap between the first door and the second door, and wherein if the second door is opened, the rotating bar is rotated as the linkage unit is linearly moved and rotated by elastic force of the elastic unit, thereby releasing sealing of the gap.

The rotating bar may include a case that internally defines an accommodation space and has an open side, an insulating member accommodated in the accommodation space, a rotating bar cover coupled to the open side of the case, a metal plate coupled to the exterior of the rotating bar cover, and a heat radiation member placed in a space between the rotating bar cover and the metal plate to prevent condensation on the metal plate.

The guide groove may be formed in the top of the case.

The rotating bar may be rotatably coupled to the first door via a hinge bracket, and the case may have a hinge bracket coupling portion to which the hinge bracket is rotatably coupled.

The guide device may further include a base having a receptacle in which the rotating unit, the linkage unit, and the elastic unit are accommodated, a cover coupled to the top of the base, and an anti-separation member provided between the cover and the base and coupled to the top of the receptacle so as to prevent separation of the rotating unit, the linkage unit, and the elastic unit accommodated in the receptacle of the base.

A ramp structure having a ramp may be fixed in the receptacle, and the linkage unit may be moved on the ramp and rotated about the rotating shaft.

The rotating unit may include a contact portion configured to come into contact with the protrusion of the second door, a guide portion configured to guide linear movement of the linkage unit, a rotating hole for penetration of the rotating shaft, and a support portion by which the elastic unit is supported.

The rotating unit may be rotated in a counterclockwise direction about the rotating shaft if the protrusion comes into contact with the contact portion to thereby push the contact portion as the second door is closed, thereby causing the linkage unit to be rotated in a counterclockwise direction about the rotating shaft, whereby the rotating bar is rotated by the linkage unit so as to seal a gap between the first door and the second door.

The linkage unit may be linearly moved and rotated in a clockwise direction on the ramp by the elastic unit as the protrusion that has pushed the contact portion of the rotating unit is separated from the contact portion if the second door is opened, whereby the rotating bar is rotated by the linkage unit so as to release sealing of the gap.

The linkage unit may include a head portion configured to come into contact with the ramp and be moved on the ramp, an insertion boss connected to the rotating bar to rotate the rotating bar, a body portion having a movement passage through which the rotating shaft passes to enable linear movement of the linkage unit, and a coupling portion to which the elastic unit is coupled.

The linkage unit may be coupled to the elastic unit supported by the support portion of the rotating unit and may be linearly moved on the ramp and rotated in a clockwise or counterclockwise direction about the rotating shaft by elastic force of the elastic unit.

The receptacle of the base may have a first coupling hole into which the rotating shaft is inserted, a first guide hole through which the insertion boss passes to thereby be inserted into the guide groove, the first guide hole serving to guide the insertion boss to allow the linkage unit to be rotated about the rotating shaft, and a second guide hole configured to outwardly expose the contact portion such that the contact portion comes into contact with the protrusion, the second guide hole serving to guide the contact portion to allow the rotating unit to be rotated about the rotating shaft.

A seating portion may be formed in an upper region of the receptacle such that the anti-separation member is seated on the seating portion, and the seating portion and the anti-separation member may be respectively provided at corresponding positions thereof with a plurality of fastening holes to couple the anti-separation member and the seating portion to each other.

The anti-separation member may have a second coupling hole into which the rotating shaft is inserted.

In accordance with another aspect of the disclosure, a refrigerator includes a main body, a storage compartment defined within the main body and having an open front side, a door including a first door and a second door rotatably coupled to the main body respectively so as to open or close the open front side of the storage compartment, a rotating bar rotatably coupled to the first door and having a guide groove formed in the top thereof, the rotating bar being rotated to seal a gap between the first door and the second door if the door is closed and to release sealing of the gap if the door is opened, and a guide device provided at the main body to guide rotation of the rotating bar, wherein the guide device includes a base having a receptacle therein, a rotating unit mounted in the receptacle so as to be rotated by a rotating shaft, a ramp structure fixed in the receptacle and having a ramp, a linkage unit linearly movably secured to the rotating unit and connected to the rotating bar, the linkage unit being linearly moved on the ramp and rotated along with the rotating unit about the rotating shaft, and an elastic unit supported by the rotating unit and adapted to transmit elastic force to the linkage unit so as to allow the linkage unit to be linearly moved on the ramp.

The second door may be provided at an upper end of a rear surface thereof with a protrusion such that the protrusion comes into contact with the rotating unit to rotate the rotating unit when the second door is closed.

If the protrusion rotates the rotating unit as the second door is closed, the rotating bar may be rotated by the linkage unit that is rotated along with the rotating unit, thereby sealing the gap between the first door and the second door, and if the second door is opened, the rotating bar may be rotated as the linkage unit is linearly moved and rotated by the elastic unit, thereby releasing sealing of the gap.

The guide device may further include a cover coupled to the top of the base, and an anti-separation member provided between the cover and the base and coupled to the top of the receptacle so as to prevent separation of the rotating unit, the ramp structure, the linkage unit, and the elastic unit accommodated in the receptacle of the base.

The rotating unit may include a contact portion configured to come into contact with the protrusion of the second door, a guide portion configured to guide linear movement of the linkage unit, a rotating hole for penetration of the rotating shaft, and a support portion by which the elastic unit is supported.

The rotating unit may be rotated in a counterclockwise direction about the rotating shaft if the protrusion comes into contact with the contact portion to thereby push the contact portion as the second door is closed, thereby causing the linkage unit to be rotated in a counterclockwise direction about the rotating shaft.

The linkage unit may include a head portion configured to come into contact with the ramp and be moved on the ramp, an insertion boss connected to the rotating bar to rotate the rotating bar, a body portion having a movement passage through which the rotating shaft passes to enable linear movement of the linkage unit, and a coupling portion to which the elastic unit is coupled.

The rotating unit may be rotated in a counterclockwise direction about the rotating shaft if the protrusion comes into contact with the contact portion to thereby push the contact portion as the second door is closed, thereby causing the linkage unit to be rotated in a counterclockwise direction about the rotating shaft, whereby the rotating bar is rotated by the linkage unit so as to seal a gap between the first door and the second door, and the linkage unit may be linearly moved and rotated in a clockwise direction on the ramp by the elastic unit as the protrusion that has pushed the contact portion of the rotating unit is separated from the contact portion if the second door is opened, whereby the rotating bar is rotated by the linkage unit so as to release sealing of the gap.

The receptacle of the base may have a first coupling hole into which the rotating shaft is rotatably inserted, a first guide hole through which the insertion boss passes to thereby be inserted into the guide groove, the first guide hole serving to guide the insertion boss to allow the linkage unit to be rotated about the rotating shaft, and a second guide hole configured to outwardly expose the contact portion such that the contact portion comes into contact with the protrusion, the second guide hole serving to guide the contact portion to allow the rotating unit to be rotated about the rotating shaft.

In accordance with another aspect of the disclosure, a refrigerator includes a main body, a storage compartment defined within the main body and having an open front side, a door including a first door and a second door rotatably coupled to the main body respectively so as to open or close the open front side of the storage compartment, the second door having a protrusion formed at an upper end of a rear surface thereof, a rotating bar rotatably coupled to the first door and having a guide groove formed in the top thereof, and a guide device provided at the main body to guide rotation of the rotating bar, wherein the rotating bar is rotated to seal a gap between the first door and the second door if the first door is closed, wherein the rotating bar is rotated to release sealing of the gap between the first door and the second door if the second door is opened in a closed state of the first door, and wherein the rotating bar is rotated to seal the gap between the first door and the second door if the second door is closed in a closed state of the first door.

In accordance with a further aspect of the disclosure, a refrigerator includes a main body, a storage compartment defined within the main body and having an open front side, a first door rotatably coupled to the main body so as to open or close a part of the open front side of the storage compartment, wherein a rotating bar is rotatably coupled to the first door, a second door rotatably coupled to the main body so as to open or close a part of the open front side of the storage compartment, wherein the second door rotates the rotating bar via opening/closing thereof, and a guide device provided at the main body to guide rotation of the rotating bar such that the rotating bar seals a gap between the first door and the second door or releases the sealing as the second door is opened or closed.

The guide device may include a base having a receptacle therein, a rotating unit mounted in the receptacle so as to be rotated by a rotating shaft, a ramp structure fixed in the receptacle and having a ramp, a linkage unit linearly movably secured to the rotating unit and connected to the rotating bar, the linkage unit being rotated along with the rotating unit about the rotating shaft so as to rotate the rotating bar, and an elastic unit supported by the rotating unit and adapted to transmit elastic force to the linkage unit so as to allow the linkage unit to be linearly moved and rotated.

The second door may be provided with a protrusion such that the protrusion comes into contact with the rotating unit to rotate the rotating unit in a counterclockwise direction about the rotating shaft when the open second door is closed, and the linkage unit may be rotated in a counterclockwise direction about the rotating shaft simultaneously with rotation of the rotating unit so as to rotate the rotating bar such that the rotating bar seals the gap between the first door and the second door.

The elastic unit may be compressed by linear movement of the linkage unit on the ramp when the linkage unit is rotated in a counterclockwise direction about the rotating shaft.

The linkage unit may be moved on the ramp and rotated in a clockwise direction about the rotating shaft by elastic force of the elastic unit as the protrusion is separated from the rotating unit when the closed second door is opened, and the rotating bar may be rotated via rotation of the linkage unit so as to release sealing of the gap between the first door and the second door.

The rotating unit and the linkage unit may be rotated in a clockwise direction about the rotating shaft so as to be moved to a position where the rotating unit comes into contact with the protrusion when the second door is closed.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
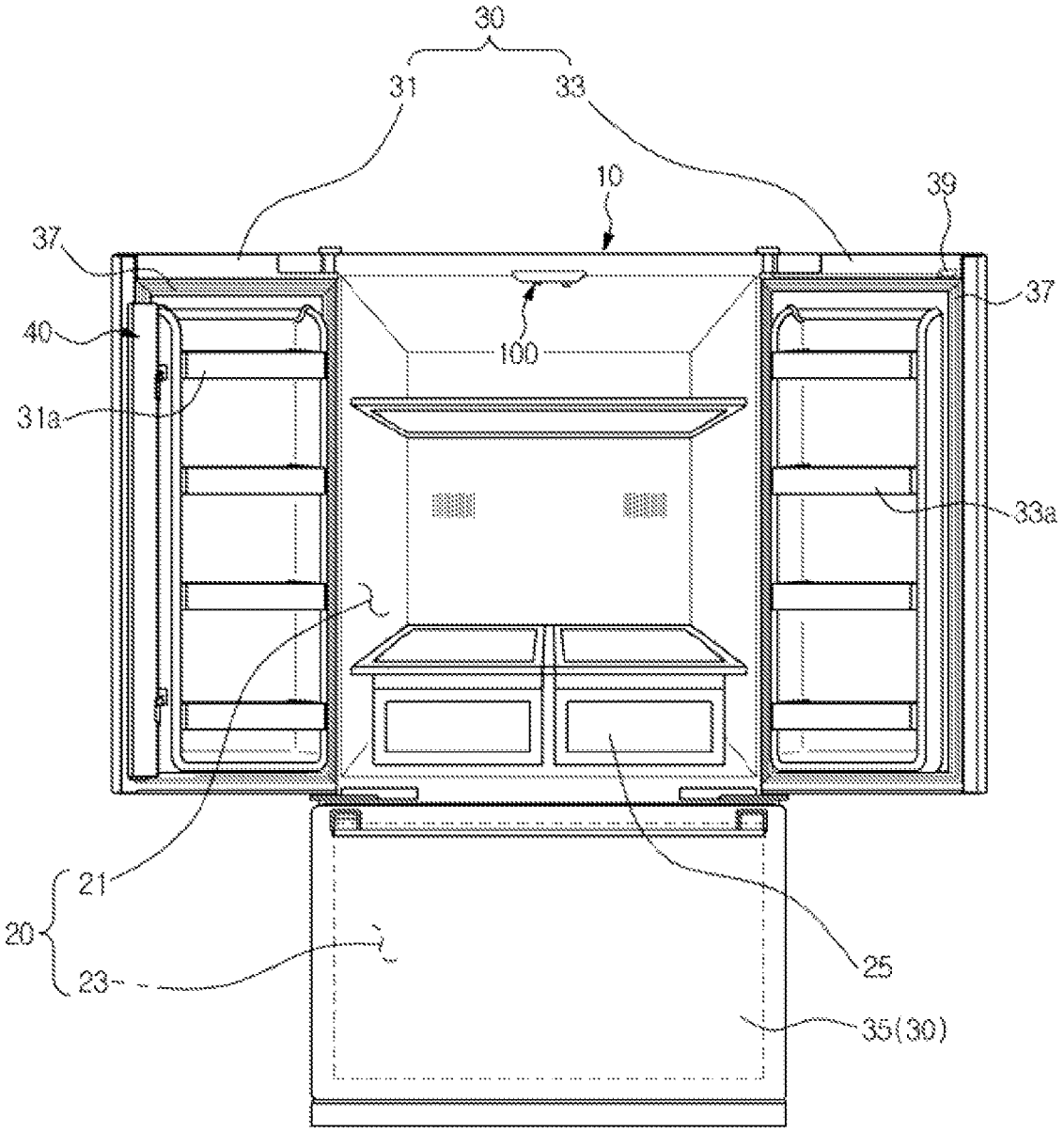
FIG. 1 is a front view showing a refrigerator according to one embodiment of the present disclosure.

Reference will now be made in detail to the embodiments of the present disclosure, examples of which are illustrated in the accompanying drawings, wherein like reference numerals refer to like elements throughout.

As exemplarily shown in FIG. 1, the refrigerator includes a main body 10 defining an external appearance of the refrigerator, storage compartments 20 vertically divided within the main body 10, doors 30 to open or close the storage compartments 20, and a cold air supply device (not shown) to supply cold air into the storage compartments 20.

The main body 10 includes an inner shell (not shown) defining the storage compartments 20, an outer shell (not shown) coupled to the exterior of the inner shell so as to define an external appearance of the main body 10, and an insulator (not shown) foamed between the inner shell and the outer shell to prevent leakage of cold air from the storage compartments 20.

The cold air supply device may include a compressor (not shown) to compress refrigerant, a condenser (not shown) to condense refrigerant, an expansion valve (not shown) to expand refrigerant, and an evaporator (not shown) to evaporate refrigerant.

The storage compartments 20 may have open front sides. The storage compartments 20 may include an upper refrigerating compartment 21 and a lower freezing compartment 23, which are vertically separated from each other by a partition 11. Storage containers 25 may be arranged in left and right regions of the refrigerating compartment 21.

The storage compartment 20 may be open or closed by the doors 30. The refrigerating compartment 21 may be open or closed by a pair of doors 31 and 33 rotatably coupled to the main body 10, and the freezing compartment 23 may be open or closed by a sliding door 35 that is slidably mounted to the main body 10.

The pair of doors 31 and 33 to open or close the refrigerating compartment 21 may be arranged respectively at left and right sides. Hereinafter, the door 31 located at the left side will be referred to as a first door, and the door 33 located at the right side will be referred to as a second door.

The first door 31 may be configured to open or close a left region of the open front side of the refrigerating compartment 21, and the second door 33 may be configured to open or close a right region of the open front side of the refrigerating compartment 21.

The first door 31 and the second door 33 may be provided at rear surfaces thereof with door shelves 31*a* and 33*a* in which food may be accommodated. A gasket 37 may be provided at the rim of the rear surface of the first door 31 and at the rim of the second door 33 to seal a gap between the doors 31 and 33 and the main body 10 when the first door 31 and the second door 33 are closed.

The gap between the first and second doors 31 and 33 and the main body 10 may be sealed by the gasket 37, which may prevent leakage of cold air between the doors 31 and 33 and the main body 10. However, leakage of cold air may occur in a gap between the first door 31 and the second door 33.

To prevent leakage of cold air between the doors 31 and 33, a rotating bar 40 may be rotatably coupled to the first door 31 so as to be rotated via opening/closing of the first door 31. The rotating bar 40 may serve to seal the gap between the first door 31 and the second door 33.

The rotating bar 40 may take the form of an elongated bar extending in a height direction of the first door 31. A guide device 100 to guide rotation of the rotating bar 40 may be provided at the main body 10.

Operation of the rotating bar 40, which is connected to the guide device 100 and is rotated via opening/closing of the first door 31 to seal the gap between the first door 31 and the second door 33, will be described later.

Figure 2:
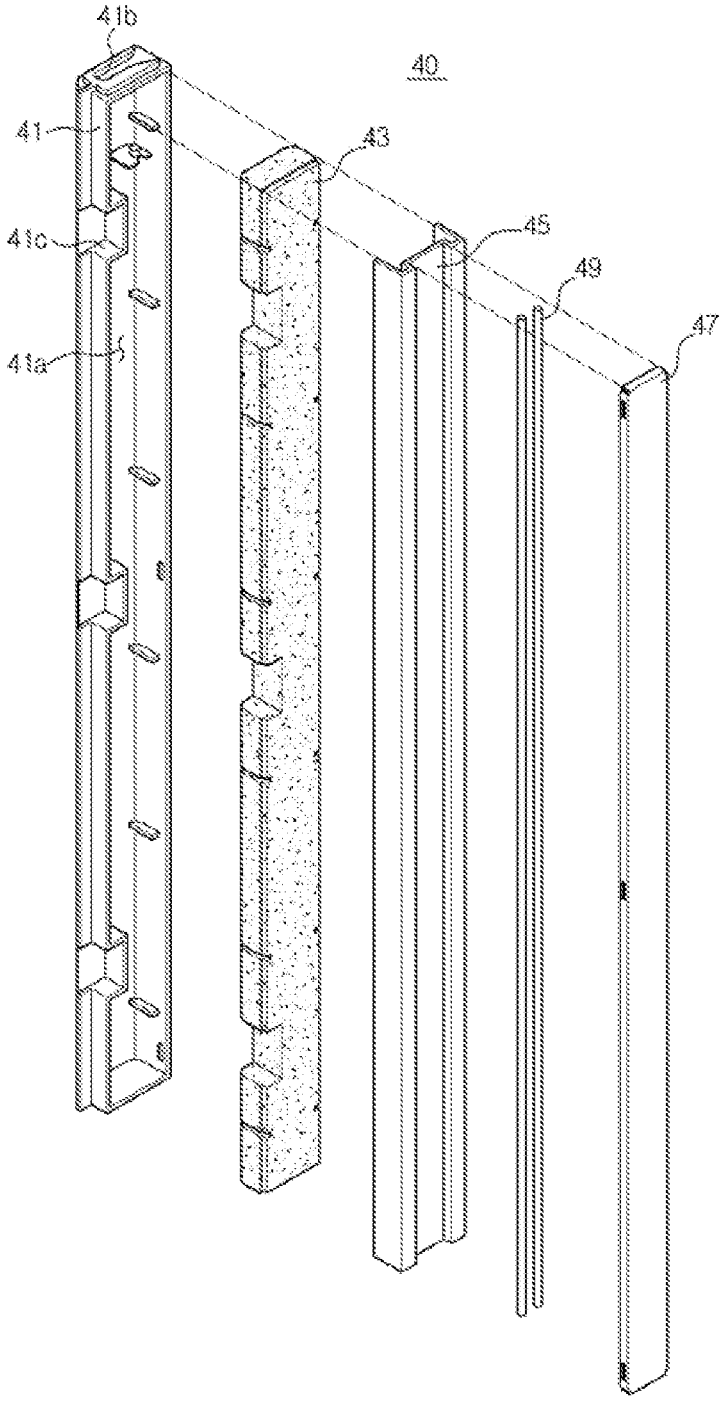
FIG. 2 is an exploded perspective view of a rotating bar according to one embodiment of the present disclosure.
Figure 3:
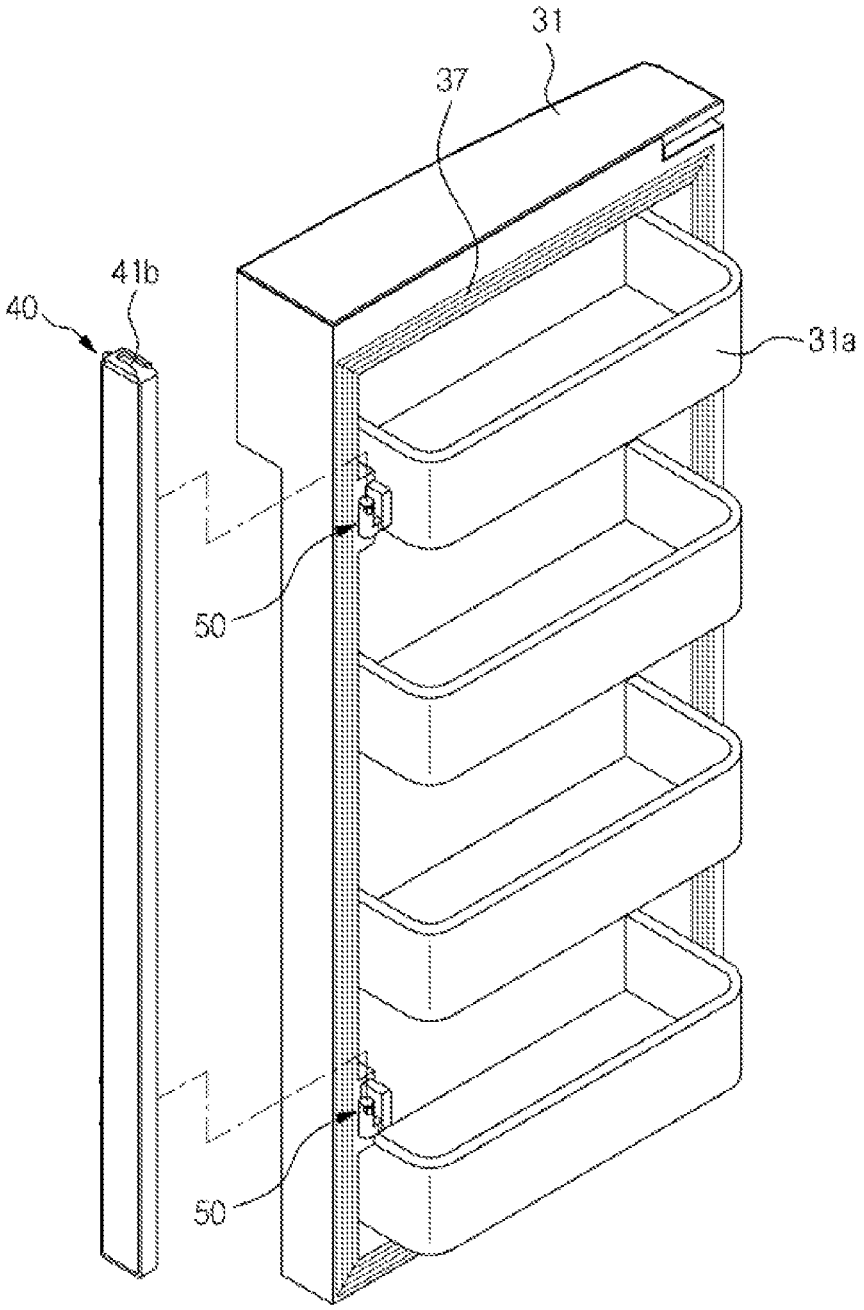
FIG. 3 is a view showing a coupling relationship between the rotating bar and a first door according to one embodiment of the present disclosure.
Figure 4:
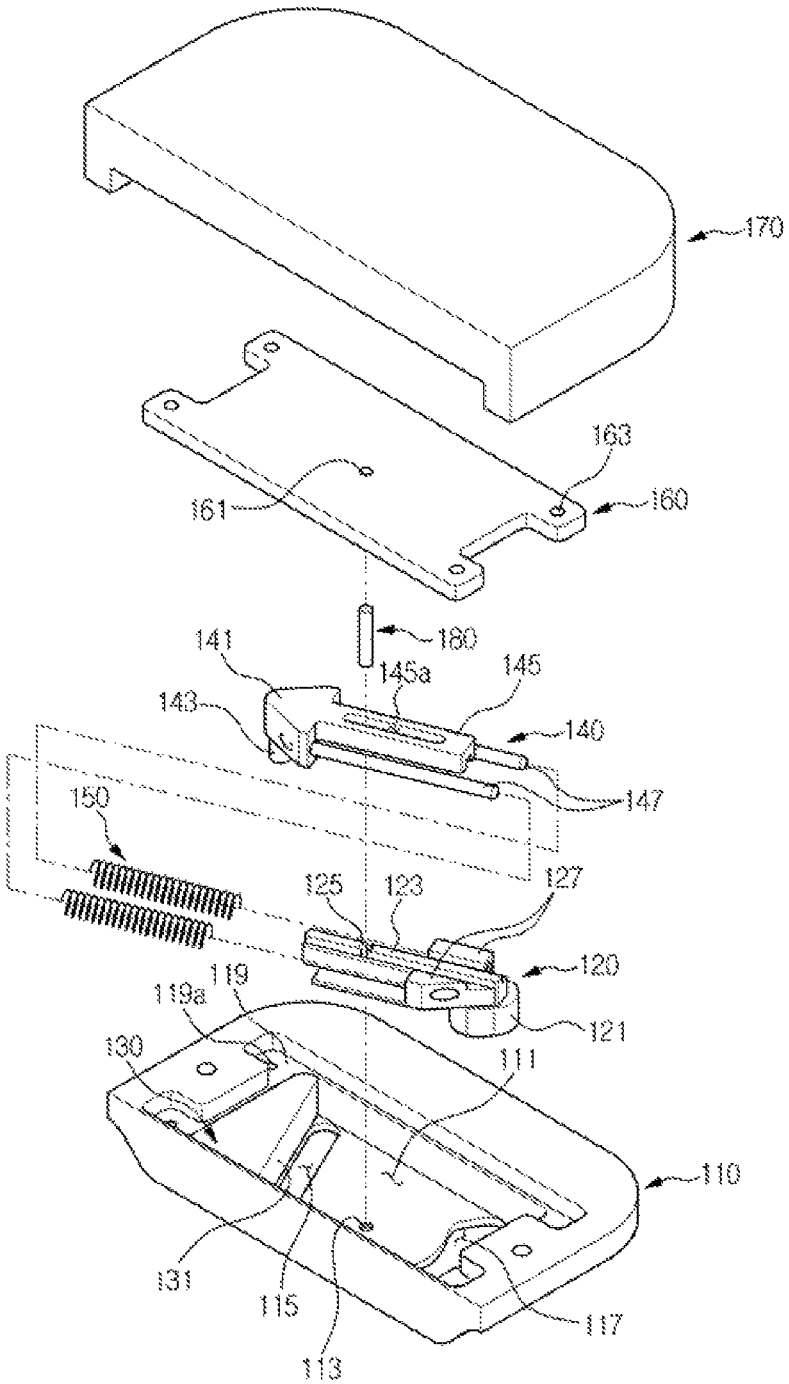
FIG. 4 is an exploded perspective view of a guide device according to one embodiment of the present disclosure.
Figure 5:
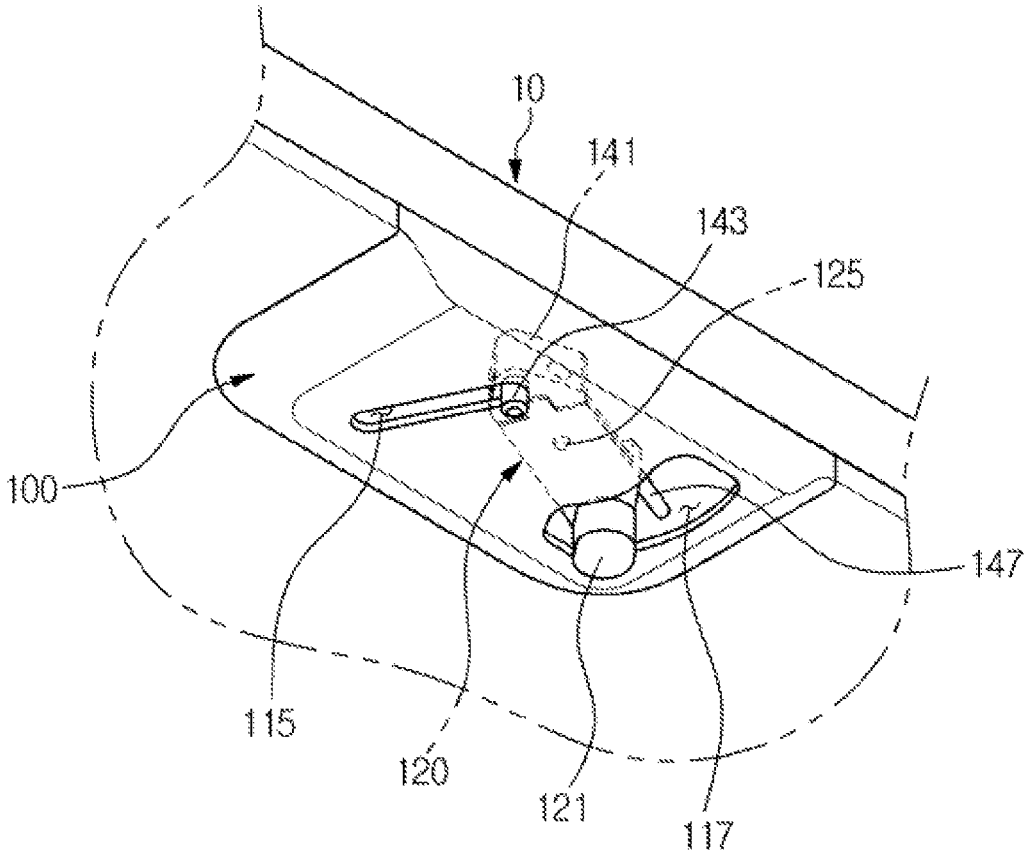
FIG. 5 is a bottom perspective view of the guide device according to one embodiment of the present disclosure.
Figure 6:
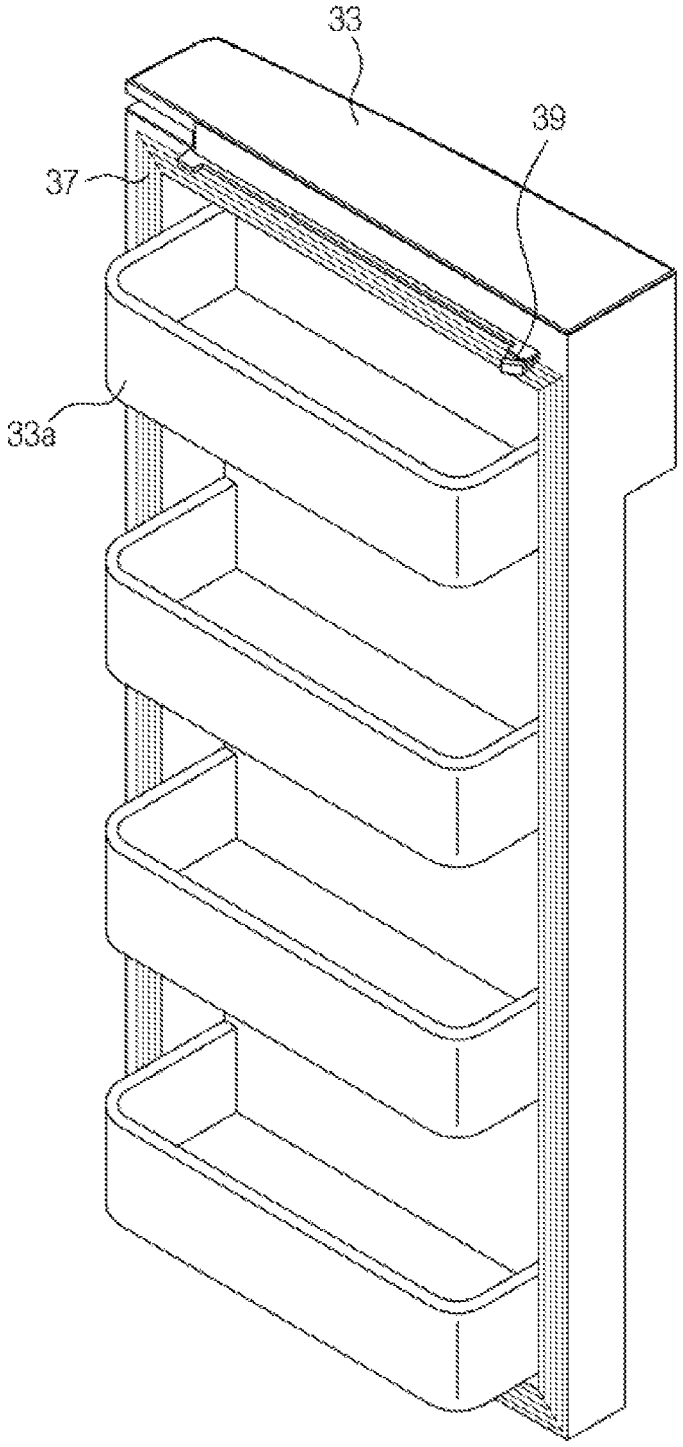
FIG. 6 is a view showing a protrusion provided at a second door according to one embodiment of the present disclosure.
Figure 7:
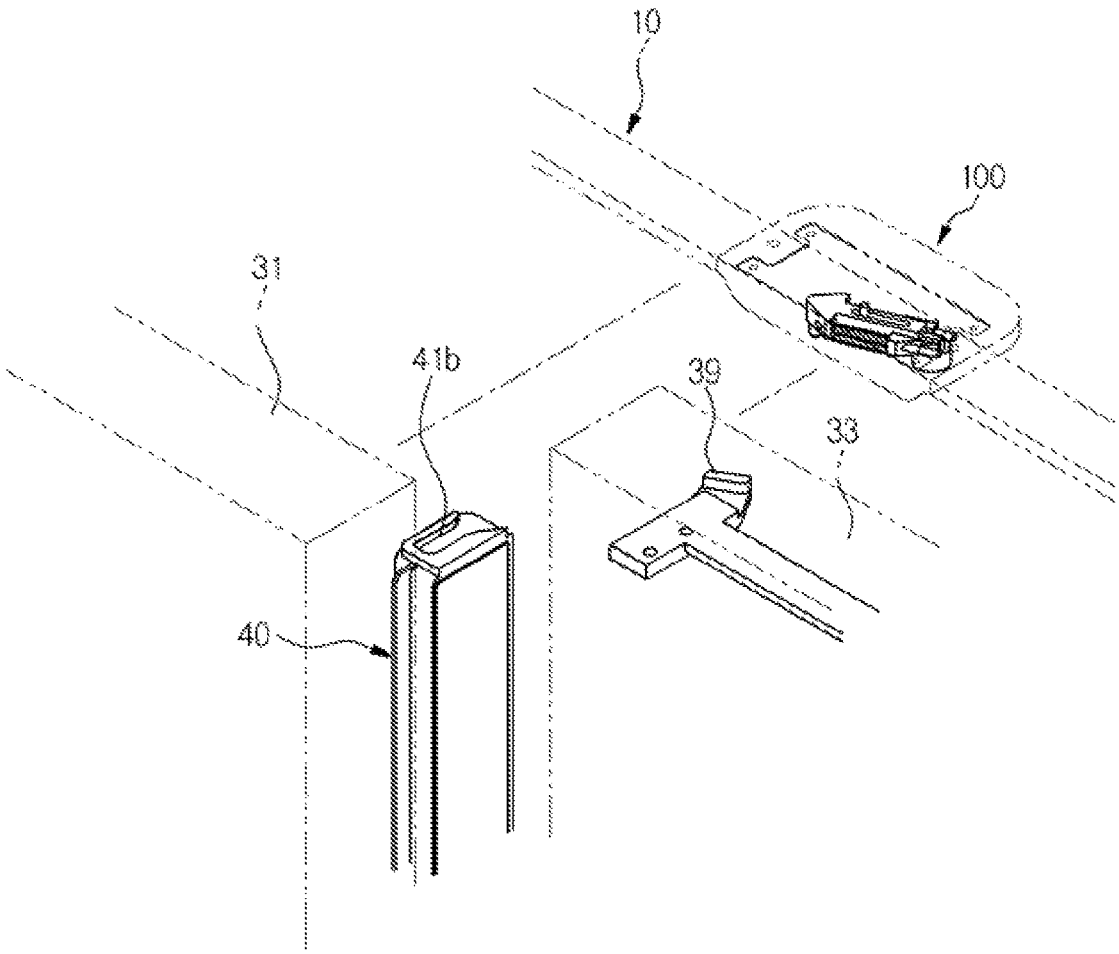
FIG. 7 is a view showing the rotating bar, the protrusion provided at the second door, and the guide device according to one embodiment of the present disclosure.

As exemplarily shown in FIGS. 2 and 3, the rotating bar 40 may include a case 41 defining an external appearance of the rotating bar 40, the case 41 having an accommodation space 41*a* therein and one side of the case 41 being open, an insulating member 43 accommodated in the accommodation space 41*a* of the case 41, a rotating bar cover 45 coupled to the open side of the case 41, a metal plate 47 coupled to the exterior of the rotating bar cover 45, and a heat radiation member 49 placed in a space between the rotating bar cover 45 and the metal plate 47.

A guide groove 41*b* is formed in the top of the case 41 for connection of the guide device 100 that will be described hereinafter. As such, rotation of the rotating bar 40 may be guided by the guide device 100.

The rotating bar 40 is rotatably coupled to the first door 31 via hinge brackets 50. The case 41 is provided with a plurality of hinge bracket coupling portions 41*c* into which the hinge brackets 50 are rotatably inserted.

The insulating member 43 serves to thermally insulate the refrigerating compartment 21. The insulating member 43 may be formed of expanded polystyrene (EPS) that has superior thermal insulation performance and is lightweight.

The insulating member 43 may be molded into a shape corresponding to the accommodation space 41*a* of the case 41, so as to be inserted into the accommodation space 41*a* of the case 41.

The rotating bar cover 45 is configured to cover the open side of the case 41. The rotating bar cover 45 may be coupled to the open side of the case 41 after the insulating member 43 is inserted into the accommodation space 41*a* of the case 41.

The rotating bar cover 45 may be formed of a plastic material having low thermal conductivity and may be integrally injection-molded.

The metal plate 47 may be coupled to the exterior of the rotating bar cover 45. The metal plate 47 may be formed of a metal to provide the rotating bar 40 with rigidity and to come into close contact with the gasket 37 by magnetic force of a magnet (not shown) included in the gasket 37.

The heat radiation member 49 may be placed in a space between the rotating bar cover 45 and the metal plate 47. Heat radiation by the heat radiation member 49 may prevent condensation on the metal plate 47 due to a temperature difference between the outside and the inside of the refrigerating compartment 21.

To prevent heat generated from the heat radiation member 49 from being excessively transferred to the metal plate 47, the heat radiation member 49 may include a heating cable fabricated by wrapping a metallic radiation wire with an insulating material, such as silicon or fluorinated ethylene propylene (FEP).

As such, the heat radiation member 49 may be arranged to realize linear contact with the metal plate 47 other than surface contact, so as to transfer only minimum heat to the metal plate 47 required to prevent condensation on the metal plate 47.

With the above-described configuration, the rotating bar 40 comes into close contact with the gasket 37 of the first door 31 and the second door 33 when the first door 31 and the second door 33 are closed, thereby sealing the gap between the first door 31 and the second door 33 and minimizing heat generated from the heat radiation member 49 of the rotating bar 40 from infiltrating the interior of the refrigerating compartment 21.

Accordingly, the rotating bar 40 may have enhanced thermal insulation performance and the heat radiation member 49 may exhibit minimized heat loss, which may achieve energy reduction for prevention of condensation on the rotating bar 40.

The rotating bar 40 is rotatably provided at the first door 31 and is connected to the guide device 100 so as to be rotated via rotation of the first door 31. The rotating bar 40 may seal the gap between the first door 31 and the second door 33 in a closed state of the first door 31 and the second door 33. However, if only the second door 33 is opened while the first door 31 remains closed, the rotating bar 40 is located to continuously seal the gap between the first door 31 and the second door 33. Therefore, if the storage containers 25 arranged in left and right regions of the refrigerating compartment 21 have the same size, the rotating bar 40 may prevent outward movement of the storage container 25 located in the right region corresponding to the second door 33. Accordingly, providing different sizes of storage containers 25 in left and right sides of the refrigerating compartment 21 may be inevitable.

In the present embodiment, to allow the storage container 25 arranged in left and right regions of the refrigerating compartment 21 to have the same size and to ensure that the storage container 25 arranged in the right region of the refrigerating compartment 21 is moved outward even when only the second door 33 corresponding to the right region of the refrigerating compartment 21 is opened, the guide device 100 is provided at the main body 100 to rotate the rotating bar 40 via opening/closing of the second door 33.

As exemplarily shown in FIGS. 1 and 4 to 7, the guide device 100 is provided at the center of an upper end of the refrigerating compartment 21 of the main body 10.

The guide device 100 includes a base 110 internally defining a receptacle 111, a rotating unit 120 rotatably mounted in the receptacle 111, a ramp structure 130 accommodated in the receptacle 110 and having a ramp 131, a linkage unit 140 connected to the rotating bar 40 and operated in linkage with the rotating unit 120, an elastic unit 150 to transmit elastic force to the linkage unit 140, an anti-separation member 160 placed at the top of the receptacle 111 to prevent separation of the rotating unit 120, the ramp structure 130, the linkage unit 140, and the elastic unit 150 accommodated in the receptacle 111, and a cover 170 placed above the anti-separation member 160 to hide the components placed in the receptacle 111 of the base 110 so as not to be exposed outward.

The guide device 100 is provided at the main body 10 to assist the rotating bar 40 in being rotated via opening/closing of the second door 33 in a closed state of the first door 31.

The second door 33 is provided with a protrusion 39 to assist the guide device 100 in rotating the rotating bar 40 via opening/closing of the second door 33.

The protrusion 39 protrudes from an upper end of the rear surface of the second door 33 at a position corresponding to the guide device 100 and is adapted to come into contact with the guide device 100 via opening/closing of the second door 33.

The rotating unit 120 is rotatably mounted in the receptacle 111 of the base 110 via a rotating shaft 180.

The rotating unit 120 includes a contact portion 121 configured to come into contact with the protrusion 39 of the second door 33, a guide portion 123 configured to guide linear movement of the linkage unit 140, a rotating hole 125 for penetration of the rotating shaft 180, and a support portion 127 by which the elastic unit 150 is supported.

The contact portion 120 is exposed outward through a second guide hole 115 perforated in the receptacle 111 of the base 110 that will be described hereinafter, and comes into contact with the protrusion 39 of the second door 33 via opening/closing of the second door 33.

The rotating shaft 180 may penetrate the rotating hole 125 such that the rotating unit 120 is rotatable about the rotating shaft 180.

A lower end of the rotating shaft 180 penetrating the rotating hole 125 is inserted into a first coupling hole 113 of the base 110 and an upper end of the rotating shaft 180 is inserted into a second coupling hole 161 of the anti-separation member 160 that will be described hereinafter.

The ramp structure 130 having the ramp 131 may be fixed in the receptacle 111 of the base 110. As a head portion 141 of the linkage unit 140 that will be described hereinafter is moved on the ramp 131, the linkage unit 140 may be rotated about the rotating shaft 180.

The linkage unit 140 may be rotated along with the rotating unit 120 via the rotating shaft 180. The linkage unit 140 may include the head portion 141 that comes into contact with the ramp structure 130 so as to be moved on the ramp 131, an insertion boss 143 that is inserted into the guide groove 41*b* of the rotating bar 40 to enable rotation of the rotating bar 40, a body portion 145 having a movement passage 145*a* for penetration of the rotating shaft 180, and a coupling portion 147 to which the elastic unit 150 is coupled.

The head portion 141 may come into contact with the ramp 131 so as to be moved on the ramp 131 via opening/closing of the second door 33, thereby enabling rotation of the linkage unit 140.

The insertion boss 143 may protrude downward from the bottom of the head portion 141 and penetrate the first guide hole 115 of the base 110 to thereby be inserted into the guide groove 41*b* of the rotating bar 40.

As such, if the linkage unit 140 is rotated, the rotating bar 40 is rotated by the insertion boss 143 inserted into the guide groove 41*b*.

The body portion 145 is connected to the head portion 141 and has the movement passage 145*a* for linear movement of the linkage unit 140 in a state in which the rotating shaft 180 penetrates the movement passage 145*a*.

The coupling portion 147 may be configured such that the elastic unit 150 is coupled to the coupling portion 147 via insertion. The elastic unit 150 assists the linkage unit 140 in linearly moving such that the linkage unit 140 is linearly movable and rotatable on the ramp 131.

The receptacle 111 indented in the base 110 may have the first coupling hole 113 into which the lower end of the rotating shaft 180 is inserted, the first guide hole 115 through which the insertion boss 143 passes to thereby be inserted into the guide groove 41*b* of the rotating bar 40, the first guide hole 115 serving to guide the insertion boss 143 to allow the linkage unit 140 to be rotated about the rotating shaft 180, and a second guide hole 117 to outwardly expose the contact portion 121 of the rotating unit 120 such that the contact portion 121 may come into contact with the protrusion 39 of the second door 33, the second guide hole 117 serving to guide the contact portion 121 to allow the contact portion 121 to be rotated about the rotating shaft 180.

A seating portion 119 is formed in an upper region of the receptacle 111 such that the anti-separation member 160 is seated on the seating portion 119 to prevent outward separation of the rotating unit 120, the ramp structure 130, the linkage unit 140, and the elastic unit 150 accommodated in the receptacle 111.

The seating portion 119 and the anti-separation member 160 are respectively provided at corresponding positions thereof with a plurality of fastening holes 119*a* and 163 to couple the anti-separation member 160 to the seating portion 119. The anti-separation member 160 is provided with the second coupling hole 161 into which the upper end of the rotating shaft 180 is inserted.

Next, operation of the guide device 100 to rotate the rotating bar 40 via opening/closing of the first door 31 and the second door 33 will be described with reference to FIGS. 8 to 15.

For convenience of description, hereinafter the upper side of the drawing will be referred to as upward, the lower side of the drawing will be referred to as downward, the left side of the drawing will be referred to as leftward, and the right side of the drawing will be referred to as rightward.

Figure 8:
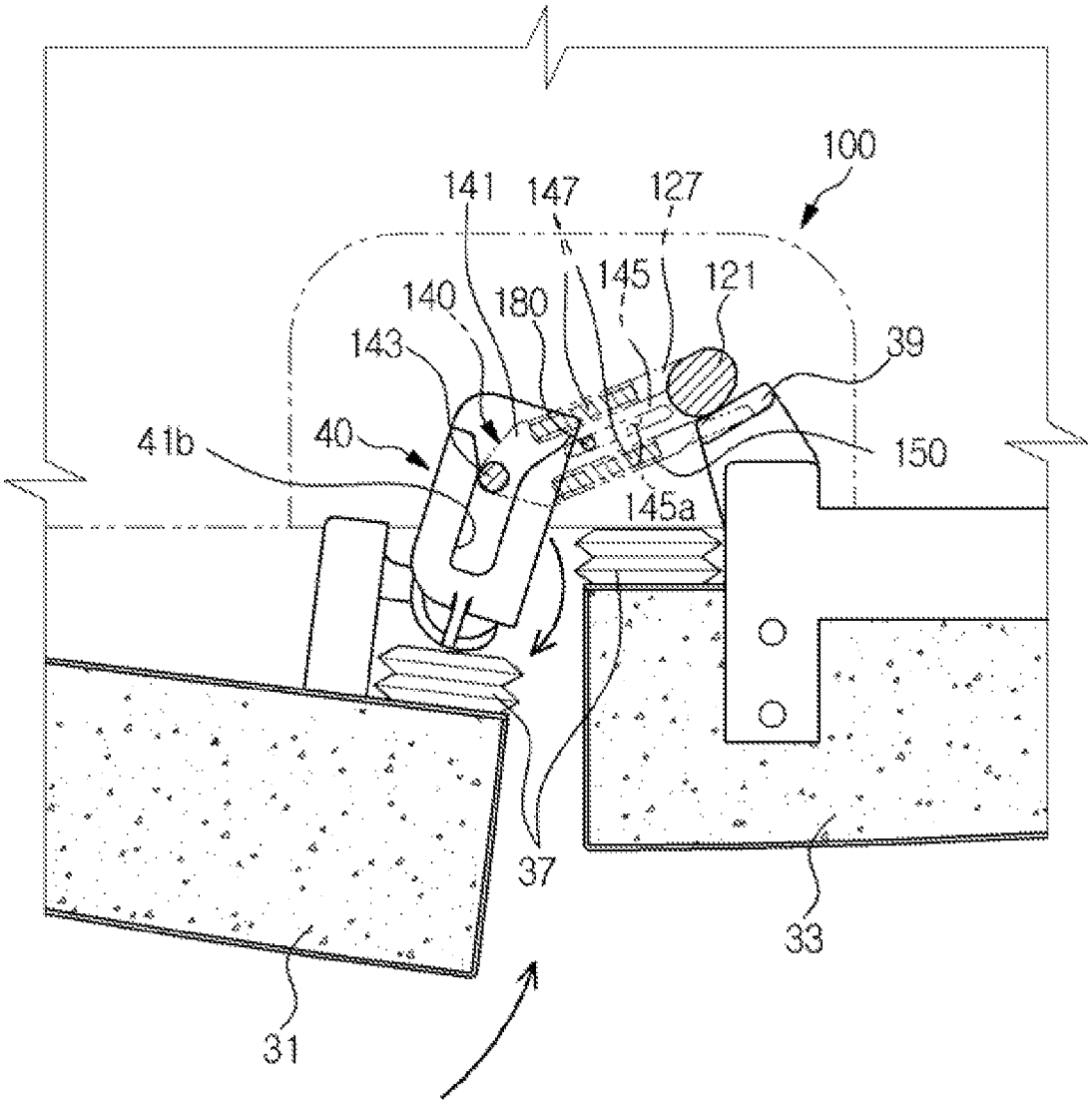
FIGS. 8 and 9 are views showing rotation of the rotating bar via opening/closing of the first door according to one embodiment of the present disclosure.

As exemplarily shown in FIG. 8, in an open state of the first door 31, the rotating bar 40 is rotated to be perpendicular to the first door 31 so as to release sealing of the gap between the first door 31 and the second door 33.

Figure 9:
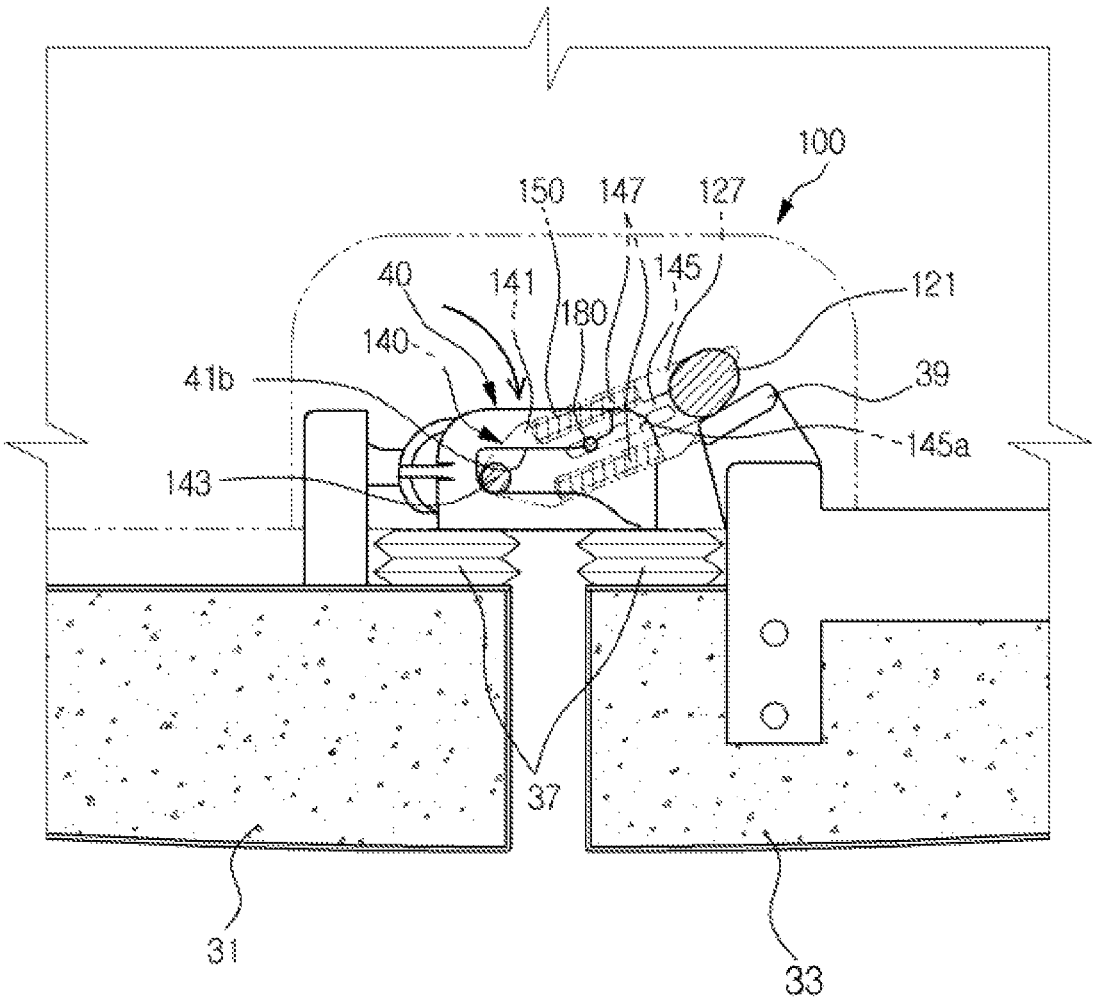

Then, if the first door 31 is closed, as exemplarily shown in FIG. 9, the rotating bar 40 is rotated to be parallel to the first door 31 so as to seal the gap between the first door 31 and the second door 33 as the guide groove 41*b* formed in the top of the rotating bar 40 is guided by the insertion boss 143 inserted into the guide groove 41*b*.

In the case in which the closed first door 31 is opened, the rotating bar 40 performs the above-described operation in reverse. Thereby, the rotating bar 40 is rotated to release sealing of the gap between the first door 31 and the second door 33.

Figure 10:
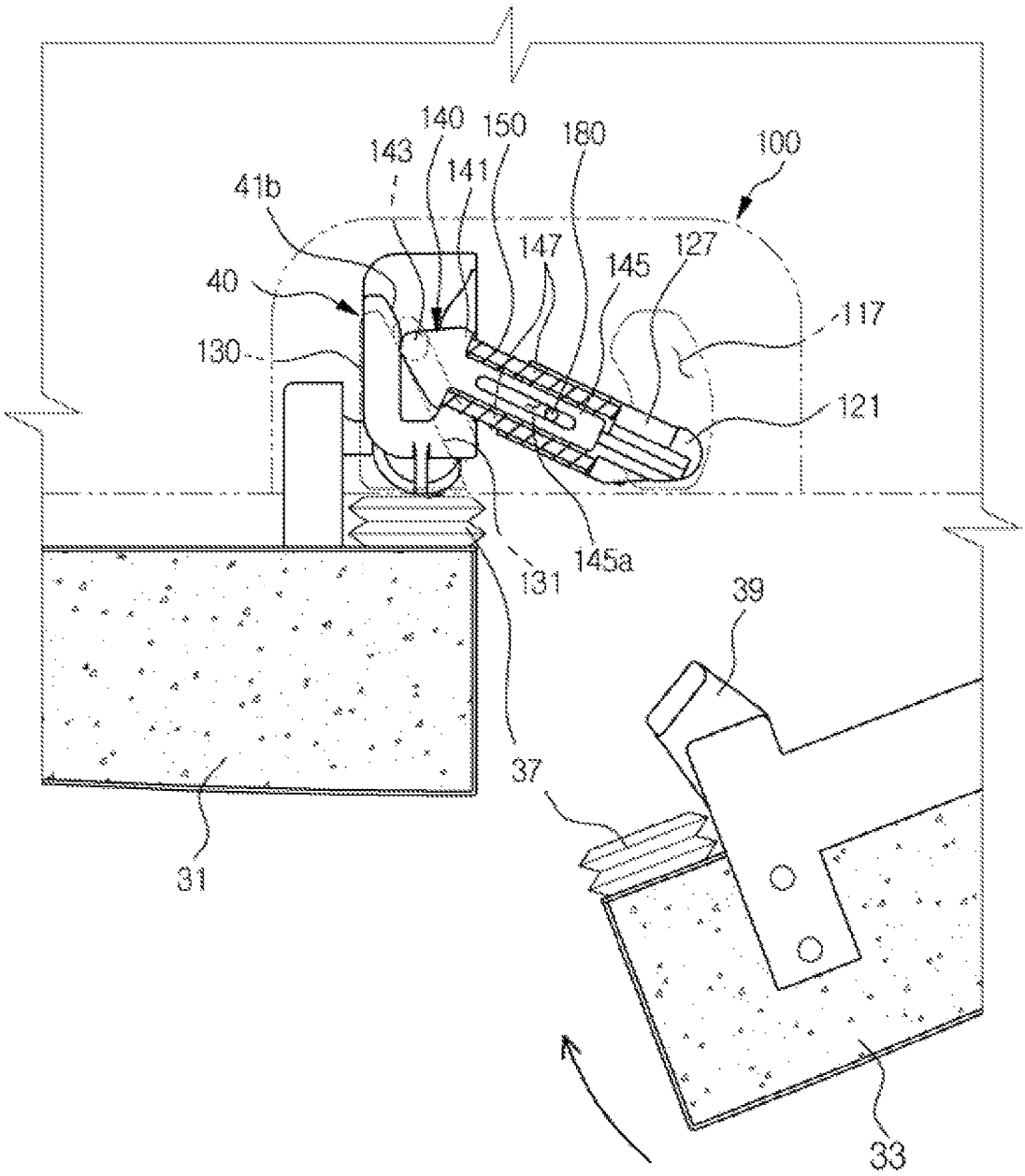
FIGS. 10 to 13 are views showing rotation of the rotating bar via closing of the second door according to one embodiment of the present disclosure.
Figure 11:
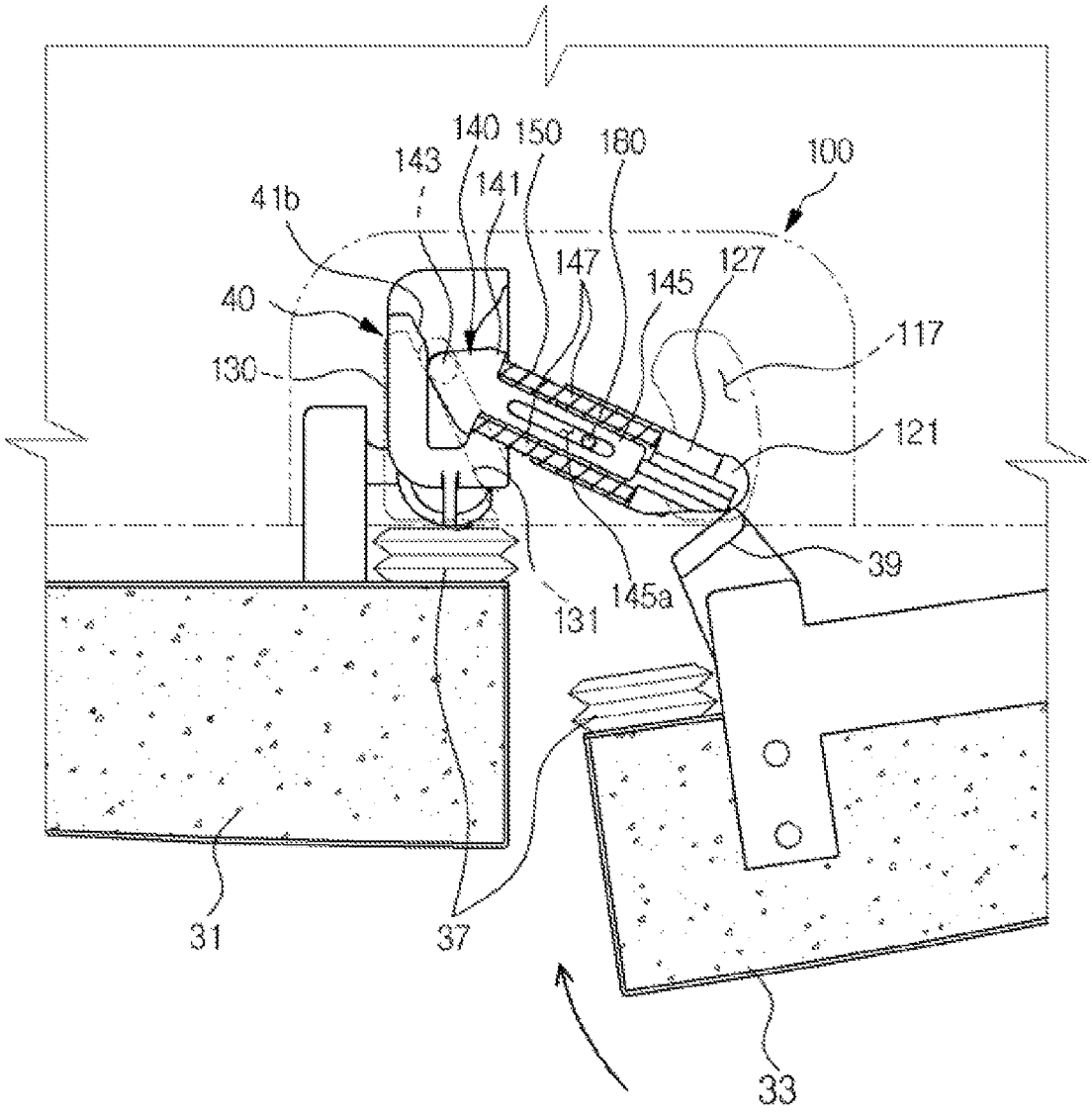

If the open second door 33 is closed in a state in which the first door 31 has been closed as exemplarily shown in FIG. 10, the protrusion 39 of the second door 33 comes into contact with the contact portion 121 of the rotating unit 120 to thereby push the contact portion 121 as exemplarily shown in FIG. 11.

Figure 12:
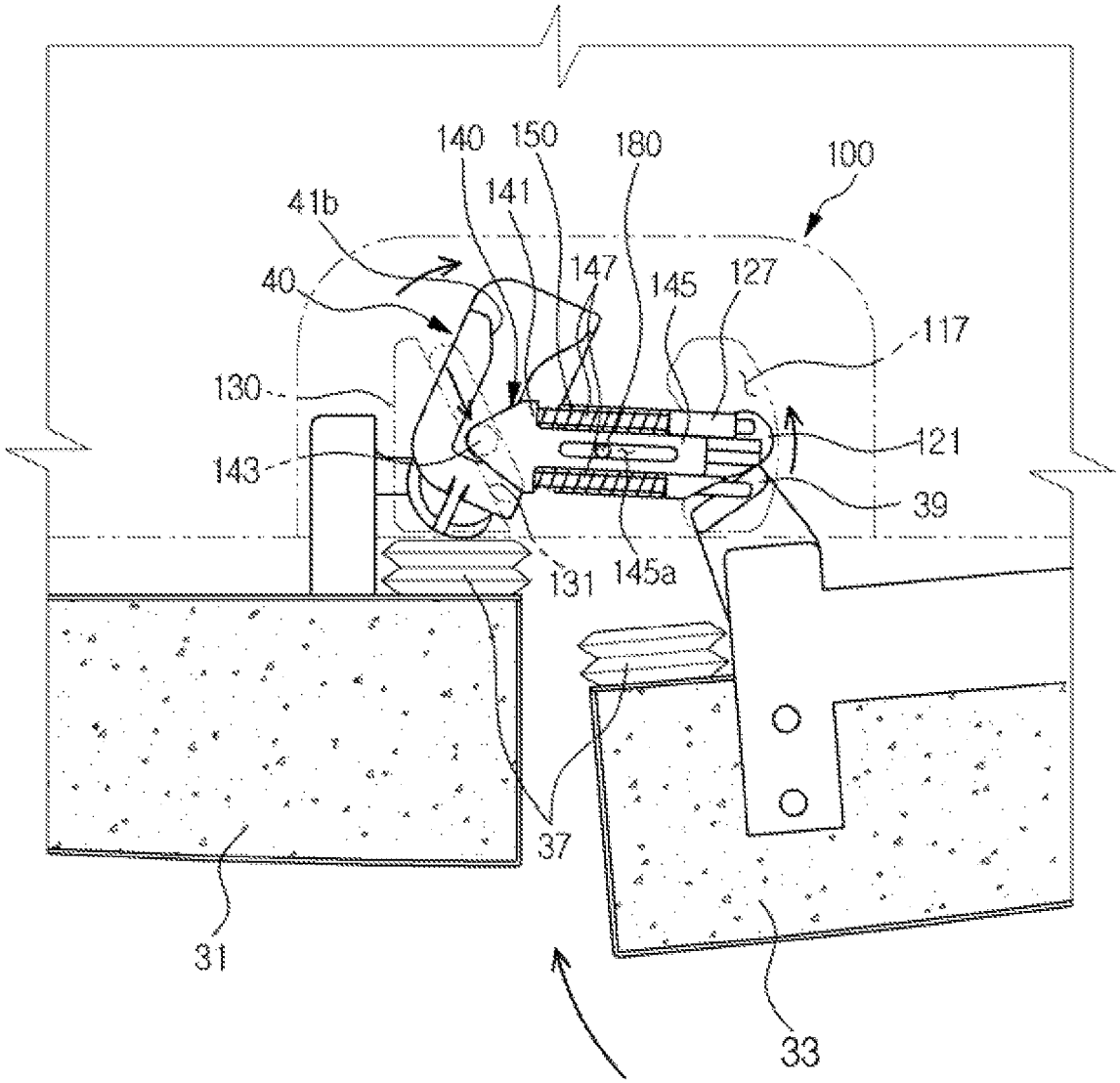
Figure 13:
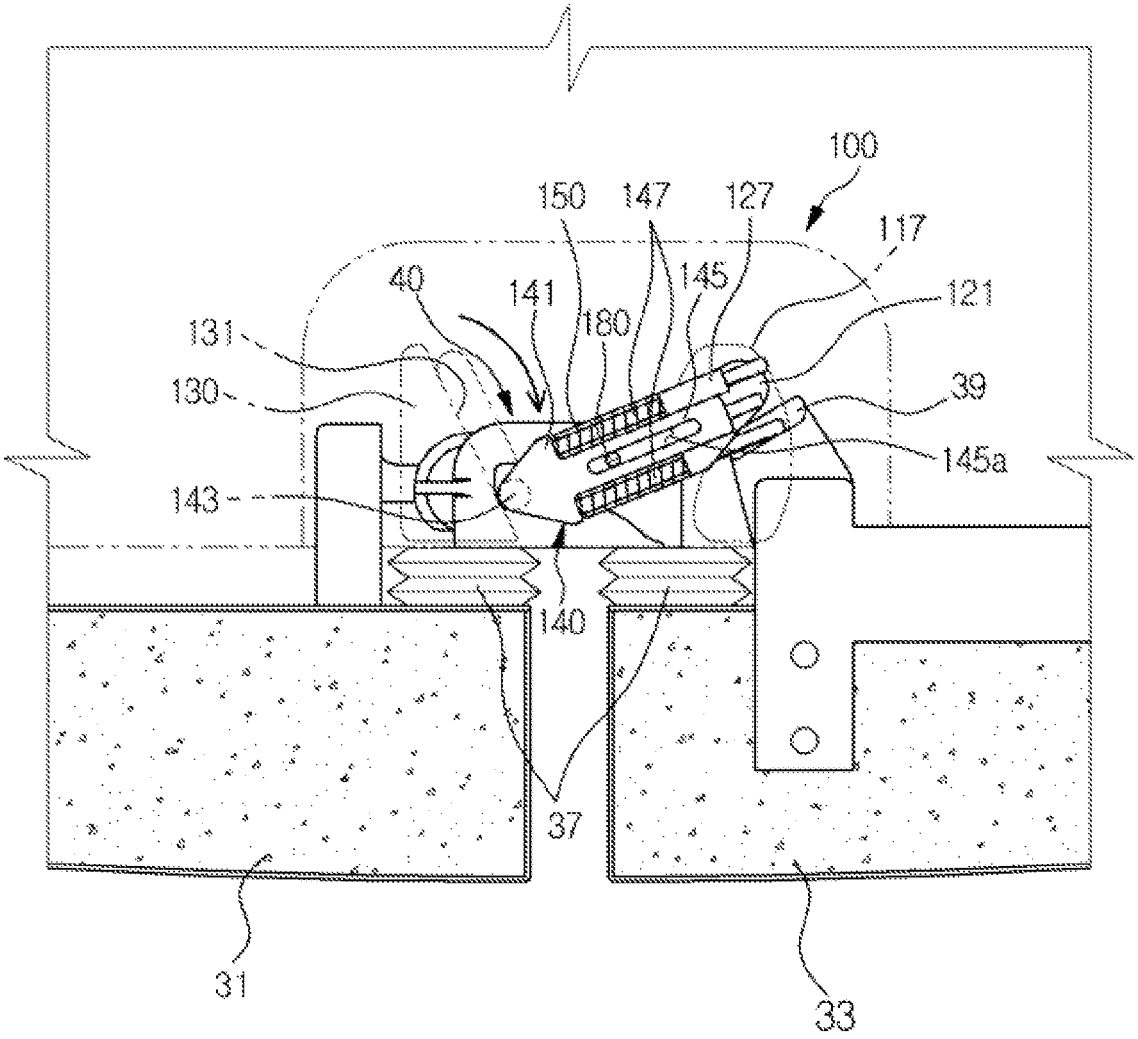

As the protrusion 39 comes into contact with the contact portion 121 to thereby push the contact portion 121, as exemplarily shown in FIG. 12, the rotating unit 120 is rotated in a counterclockwise direction about the rotating shaft 180.

If the rotating unit 120 is rotated in a counterclockwise direction, the linkage unit 140, which is adapted to be rotated in linkage with the rotating unit 120, is simultaneously rotated in a counterclockwise direction about the rotating shaft 180.

Through this counterclockwise rotation, the linkage unit 140 is moved rearward as the head portion 141 of the linkage unit 140 is moved downward on the ramp 131, thereby compressing the elastic unit 150. Simultaneously, the insertion boss 143 provided at the bottom of the head portion 141 causes the rotating bar 40 to be rotated in a clockwise direction while remaining inserted in the guide groove 41*b* of the rotating bar 40. Thereby, as exemplarily shown in FIG. 13, the rotating bar 40 seals the gap between the first door 31 and the second door 33 when the second door 33 is closed.

Figure 14:
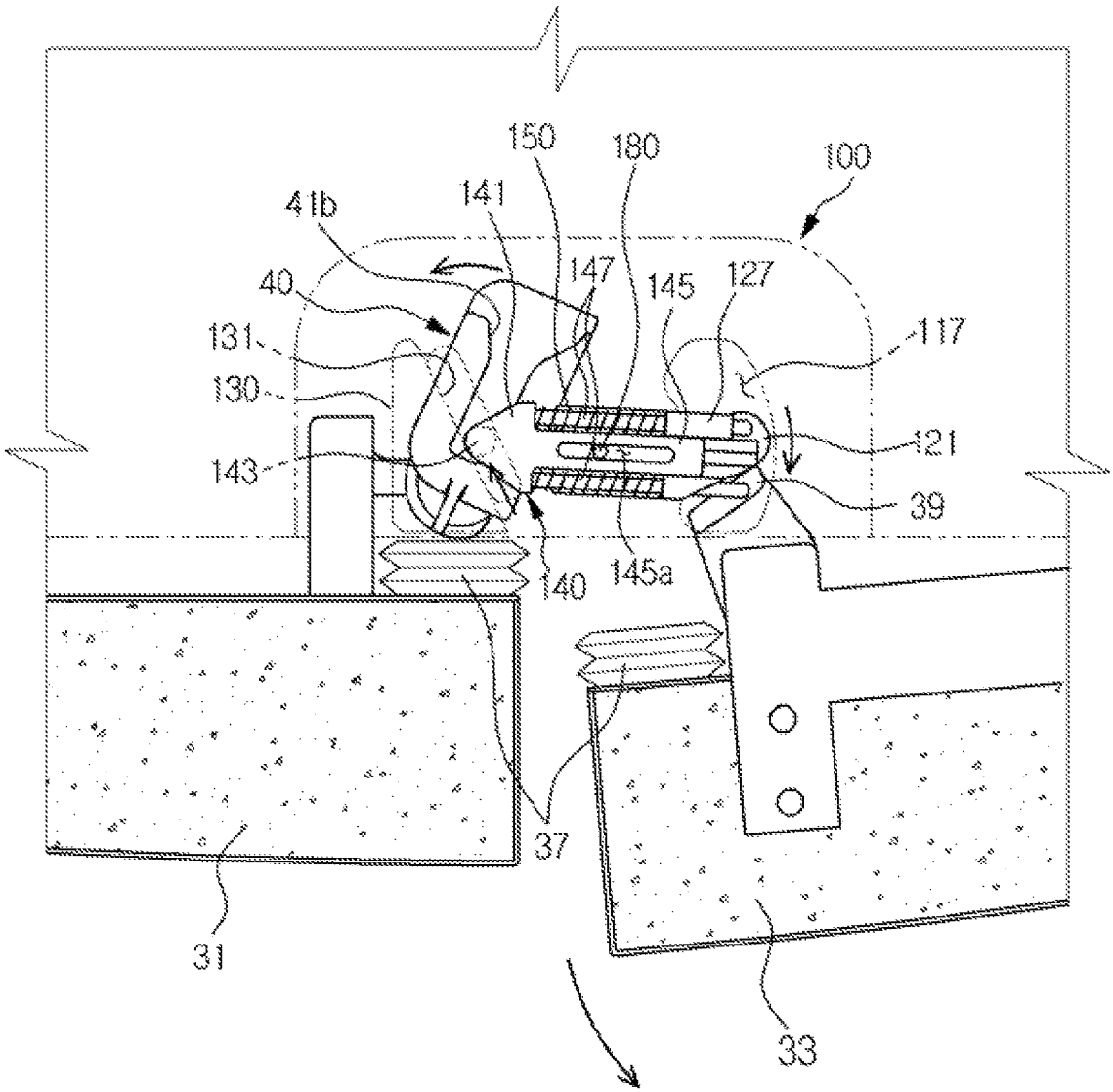
FIGS. 14 and 15 are views showing rotation of the rotating bar via opening of the second door according to one embodiment of the present disclosure.
Figure 15:
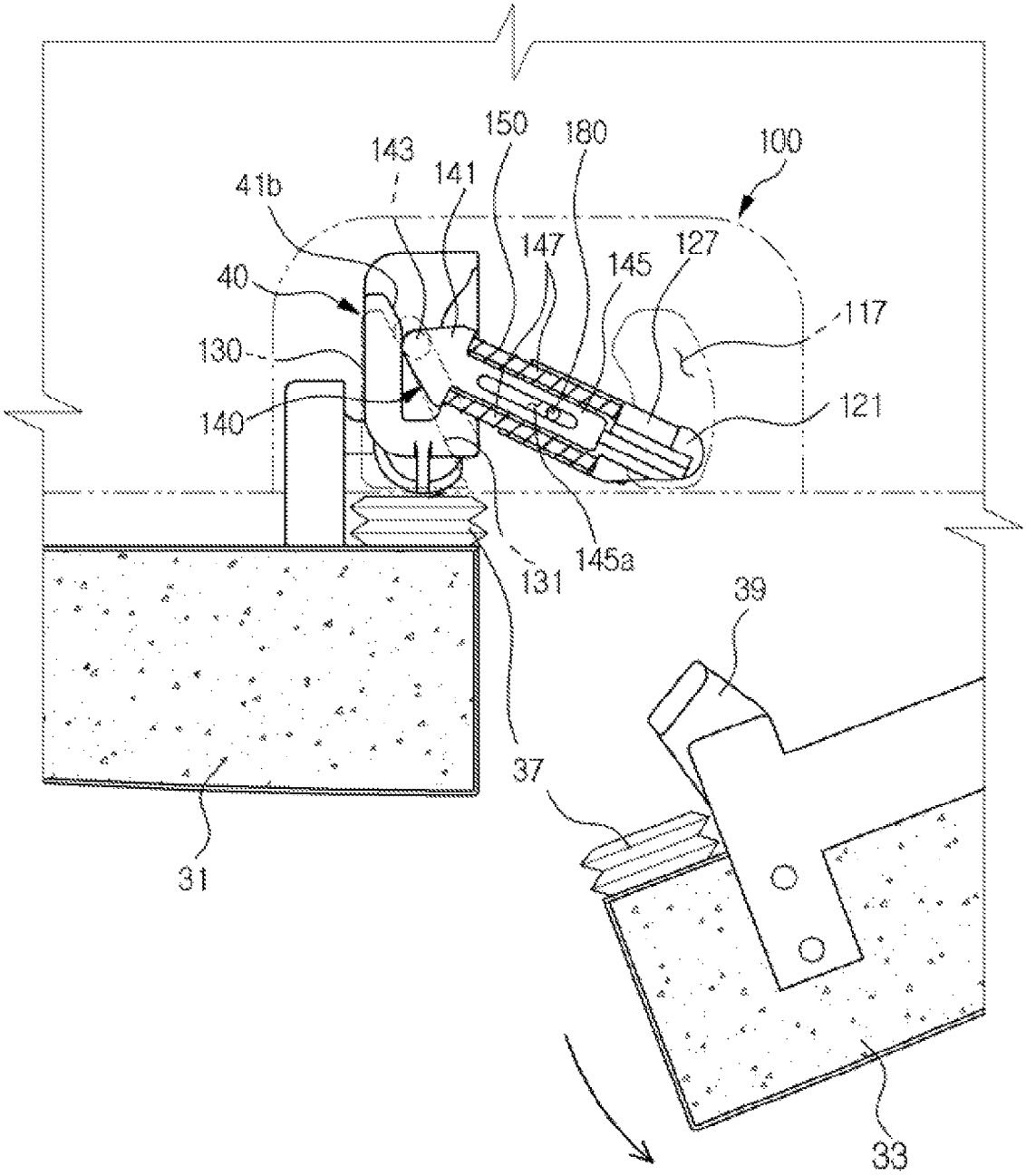

If the closed second door 33 is opened, as exemplarily shown in FIG. 14, the protrusion 39 provided at the second door 33 is separated from the contact portion 121 of the rotating unit 120 and the linkage unit 140 is moved forward by the compressed elastic unit 150 such that the head portion 141 of the linkage unit 140 is moved upward on the ramp 131.

As the head portion 141 is moved upward on the ramp 131, the linkage unit 140 is rotated in a clockwise direction about the rotating shaft 180, and simultaneously the rotating unit 120 is rotated in a clockwise direction about the rotating shaft 180.

Through clockwise rotation of the linkage unit 140, the insertion boss 143 of the linkage unit 140 causes the rotating bar 40 to be rotated in a clockwise direction while remaining inserted in the guide groove 41*b* of the rotating bar 40. Thereby, if the second door 33 is closed, as exemplarily shown in FIG. 15, the rotating bar 40 seals the gap between the first door 31 and the second door 33.

As is apparent from the above description, according to the embodiments of the present disclosure, the same size of storage containers may be arranged in left and right sides of a refrigerating compartment, which ensures common use of inner shell elements.

Although the embodiments of the present disclosure have been shown and described, it would be appreciated by those skilled in the art that changes may be made in the embodiment without departing from the principles and spirit of the disclosure, the scope of which is defined in the claims and their equivalents.

What is claimed is:

1. A refrigerator comprising:

a main body;

a storage compartment defined within the main body and having an open front side;

a door including a first door and a second door rotatably coupled to the main body respectively so as to open or close the open front side of the storage compartment, the second door having a protrusion formed at an upper end of a rear surface thereof;

a rotating bar rotatably coupled to the first door and having a guide groove formed in the top thereof; and a guide device provided at the main body to guide rotation of the rotating bar, wherein the guide device includes a rotating unit configured to be rotated by a rotating shaft;

a linkage unit linearly movably secured to the rotating unit and connected to the rotating bar, the linkage unit being rotated along with the rotating unit about the rotating shaft so as to rotate the rotating bar; and an elastic unit supported by the rotating unit and adapted to allow the linkage unit to be linearly moved and rotated by transmitting elastic force to the linkage unit, wherein if the protrusion rotates the rotating unit as the second door is closed, the rotating bar is rotated by the linkage unit that is rotated along with the rotating unit, thereby sealing a gap between the first door and the second door, and wherein if the second door is opened, the rotating bar is rotated as the linkage unit is linearly moved and rotated by elastic force of the elastic unit, thereby releasing sealing of the gap.

2. The refrigerator according to claim 1, wherein the rotating bar includes:

a case that internally defines an accommodation space and has an open side;

an insulating member accommodated in the accommodation space;

a rotating bar cover coupled to the open side of the case;

a metal plate coupled to an exterior of the rotating bar cover; and a heat radiation member placed in a space between the rotating bar cover and the metal plate to prevent condensation on the metal plate.

3. The refrigerator according to claim 2, wherein the guide groove is formed in a top of the case.

4. The refrigerator according to claim 2, wherein the rotating bar is rotatably coupled to the first door via a hinge bracket, and the case has a hinge bracket coupling portion to which the hinge bracket is rotatably coupled.

5. The refrigerator according to claim 1, wherein the guide device further includes:

a base having a receptacle in which the rotating unit, the linkage unit, and the elastic unit are accommodated;

a cover coupled to the top of the base; and an anti-separation member provided between the cover and the base, the anti-separation member being coupled to a top of the receptacle so as to prevent separation of the rotating unit, the linkage unit, and the elastic unit accommodated in the receptacle of the base.

6. The refrigerator according to claim 5, wherein a ramp structure having a ramp is fixed in the receptacle, and the linkage unit is moved on the ramp and rotated about the rotating shaft.

7. The refrigerator according to claim 6, wherein the rotating unit includes:

a contact portion configured to come into contact with the protrusion of the second door;

a guide portion configured to guide linear movement of the linkage unit;

a rotating hole for penetration of the rotating shaft; and a support portion by which the elastic unit is supported.

8. The refrigerator according to claim 7, wherein the rotating unit is rotated in a counterclockwise direction about the rotating shaft if the protrusion comes into contact with the contact portion to thereby push the contact portion as the second door is closed, thereby causing the linkage unit to be rotated in a counterclockwise direction about the rotating shaft, whereby the rotating bar is rotated by the linkage unit so as to seal a gap between the first door and the second door.

9. The refrigerator according to claim 8, wherein the linkage unit is linearly moved and rotated in a clockwise direction on the ramp by the elastic unit as the protrusion that has pushed the contact portion of the rotating unit is separated from the contact portion if the second door is opened, whereby the rotating bar is rotated by the linkage unit so as to release sealing of the gap.

10. The refrigerator according to claim 9, wherein the linkage unit includes:

a head portion configured to come into contact with the ramp and be moved on the ramp;

an insertion boss connected to the rotating bar to rotate the rotating bar;

a body portion having a movement passage through which the rotating shaft passes to enable linear movement of the linkage unit; and a coupling portion to which the elastic unit is coupled.

11. The refrigerator according to claim 10, wherein the linkage unit is coupled to the elastic unit supported by the support portion of the rotating unit and is linearly moved on the ramp and rotated in a clockwise or counterclockwise direction about the rotating shaft by elastic force of the elastic unit.

12. The refrigerator according to claim 11, wherein the receptacle of the base has a first coupling hole into which the rotating shaft is inserted, a first guide hole through which the insertion boss passes to thereby be inserted into the guide groove, the first guide hole serving to guide the insertion boss to allow the linkage unit to be rotated about the rotating shaft, and a second guide hole configured to outwardly expose the contact portion such that the contact portion comes into contact with the protrusion, the second guide hole serving to guide the contact portion to allow the rotating unit to be rotated about the rotating shaft.

13. The refrigerator according to claim 12, wherein a seating portion is formed in an upper region of the receptacle such that the anti-separation member is seated on the seating portion, and the seating portion and the anti-separation member are respectively provided at corresponding positions thereof with a plurality of fastening holes to couple the anti-separation member and the seating portion to each other.

14. The refrigerator according to claim 13, wherein the anti-separation member has a second coupling hole into which the rotating shaft is inserted.

15. A refrigerator comprising:

a main body;

a storage compartment defined within the main body and having an open front side;

a door including a first door and a second door rotatably coupled to the main body respectively so as to open or close the open front side of the storage compartment;

a rotating bar rotatably coupled to the first door and having a guide groove formed in the top thereof, the rotating bar being rotated to seal a gap between the first door and the second door if the door is closed and to release sealing of the gap if the door is opened; and a guide device provided at the main body to guide rotation of the rotating bar, wherein the guide device includes a base having a receptacle therein;

a rotating unit mounted in the receptacle so as to be rotated by a rotating shaft;

a ramp structure fixed in the receptacle and having a ramp;

a linkage unit linearly movably secured to the rotating unit and connected to the rotating bar, the linkage unit being linearly moved on the ramp and rotated along with the rotating unit about the rotating shaft; and an elastic unit supported by the rotating unit and adapted to transmit elastic force to the linkage unit so as to allow the linkage unit to be linearly moved on the ramp.

16. The refrigerator according to claim 15, wherein the second door is provided at an upper end of a rear surface thereof with a protrusion such that the protrusion comes into contact with the rotating unit to rotate the rotating unit when the second door is closed.

17. The refrigerator according to claim 16, wherein if the protrusion rotates the rotating unit as the second door is closed, the rotating bar is rotated by the linkage unit that is rotated along with the rotating unit, thereby sealing the gap between the first door and the second door, and wherein if the second door is opened, the rotating bar is rotated as the linkage unit is linearly moved and rotated by the elastic unit, thereby releasing sealing of the gap.

18. The refrigerator according to claim 17, wherein the guide device further includes:

a cover coupled to a top of the base; and an anti-separation member provided between the cover and the base and coupled to a top of the receptacle so as to prevent separation of the rotating unit, the ramp structure, the linkage unit, and the elastic unit accommodated in the receptacle of the base.

19. The refrigerator according to claim 18, wherein the rotating unit includes:

a contact portion configured to come into contact with the protrusion of the second door;

a guide portion configured to guide linear movement of the linkage unit;

a rotating hole for penetration of the rotating shaft; and a support portion by which the elastic unit is supported.

20. The refrigerator according to claim 19, wherein the rotating unit is rotated in a counterclockwise direction about the rotating shaft if the protrusion comes into contact with the contact portion to thereby push the contact portion as the second door is closed, thereby causing the linkage unit to be rotated in a counterclockwise direction about the rotating shaft.

21. The refrigerator according to claim 20, wherein the linkage unit includes:

a head portion configured to come into contact with the ramp and be moved on the ramp;

an insertion boss connected to the rotating bar to rotate the rotating bar;

a body portion having a movement passage through which the rotating shaft passes to enable linear movement of the linkage unit; and a coupling portion to which the elastic unit is coupled.

22. The refrigerator according to claim 21, wherein the rotating unit is rotated in a counterclockwise direction about the rotating shaft if the protrusion comes into contact with the contact portion to thereby push the contact portion as the second door is closed, thereby causing the linkage unit to be rotated in a counterclockwise direction about the rotating shaft, whereby the rotating bar is rotated by the linkage unit so as to seal a gap between the first door and the second door, and wherein the linkage unit is linearly moved and rotated in a clockwise direction on the ramp by the elastic unit as the protrusion that has pushed the contact portion of the rotating unit is separated from the contact portion if the second door is opened, whereby the rotating bar is rotated by the linkage unit so as to release sealing of the gap.

23. The refrigerator according to claim 22, wherein the receptacle of the base has a first coupling hole into which the rotating shaft is rotatably inserted, a first guide hole through which the insertion boss passes to thereby be inserted into the guide groove, the first guide hole serving to guide the insertion boss to allow the linkage unit to be rotated about the rotating shaft, and a second guide hole configured to outwardly expose the contact portion such that the contact portion comes into contact with the protrusion, the second guide hole serving to guide the contact portion to allow the rotating unit to be rotated about the rotating shaft.

24. A refrigerator comprising:

a main body;

a storage compartment defined within the main body and having an open front side;

a door including a first door and a second door rotatably coupled to the main body respectively so as to open or close the open front side of the storage compartment, the second door having a protrusion formed at an upper end of a rear surface thereof;

a rotating bar rotatably coupled to the first door and having a guide groove formed in the top thereof; and a guide device provided at the main body to guide rotation of the rotating bar, wherein the rotating bar is rotated to seal a gap between the first door and the second door if the first door is closed, wherein the rotating bar is rotated to release sealing of the gap between the first door and the second door if the second door is opened in a closed state of the first door, and wherein the rotating bar is rotated to seal the gap between the first door and the second door if the second door is closed in a closed state of the first door.

25. A refrigerator comprising:

a main body;

a storage compartment defined within the main body and having an open front side;

a first door rotatably coupled to the main body so as to open or close a part of the open front side of the storage compartment, wherein a rotating bar is rotatably coupled to the first door;

a second door rotatably coupled to the main body so as to open or close a part of the open front side of the storage compartment, wherein the second door rotates the rotating bar via opening/closing thereof; and a guide device provided at the main body to guide rotation of the rotating bar such that the rotating bar seals a gap between the first door and the second door or releases the sealing as the second door is opened or closed.

26. The refrigerator according to claim 25, wherein the guide device includes:

a base having a receptacle therein;

a rotating unit mounted in the receptacle so as to be rotated by a rotating shaft;

a ramp structure fixed in the receptacle and having a ramp;

a linkage unit linearly movably secured to the rotating unit and connected to the rotating bar, the linkage unit being rotated along with the rotating unit about the rotating shaft so as to rotate the rotating bar; and an elastic unit supported by the rotating unit and adapted to transmit elastic force to the linkage unit so as to allow the linkage unit to be linearly moved and rotated.

27. The refrigerator according to claim 26, wherein the second door is provided with a protrusion such that the protrusion comes into contact with the rotating unit to rotate the rotating unit in a counterclockwise direction about the rotating shaft when the open second door is closed, and the linkage unit is rotated in a counterclockwise direction about the rotating shaft simultaneously with rotation of the rotating unit so as to rotate the rotating bar such that the rotating bar seals the gap between the first door and the second door.

28. The refrigerator according to claim 27, wherein the elastic unit is compressed by linear movement of the linkage unit on the ramp when the linkage unit is rotated in a counterclockwise direction about the rotating shaft.

29. The refrigerator according to claim 28, wherein the linkage unit is moved on the ramp and rotated in a clockwise direction about the rotating shaft by elastic force of the elastic unit as the protrusion is separated from the rotating unit when the closed second door is opened, and the rotating bar is rotated via rotation of the linkage unit so as to release sealing of the gap between the first door and the second door.

30. The refrigerator according to claim 29, wherein the rotating unit and the linkage unit are rotated in a clockwise direction about the rotating shaft so as to be moved to a position where the rotating unit comes into contact with the protrusion when the second door is closed.

* * * * *